US010267455B2

(12) United States Patent
Sassi et al.

(10) Patent No.: US 10,267,455 B2
(45) Date of Patent: Apr. 23, 2019

(54) SEALED INSULATING TANK AND METHOD OF MANUFACTURING THE SAME

(71) Applicant: GAZTRANSPORT ET TECHNIGAZ, Saint Remy les Chevreuse (FR)

(72) Inventors: Mohamed Sassi, Meudon-la-Foret (FR); Mathieu Wong, Abbeville (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 320 days.

(21) Appl. No.: 15/318,894

(22) PCT Filed: Jun. 23, 2015

(86) PCT No.: PCT/EP2015/064144

§ 371 (c)(1),
(2) Date: Dec. 14, 2016

(87) PCT Pub. No.: WO2015/197638

PCT Pub. Date: Dec. 30, 2015

(65) Prior Publication Data

US 2017/0138537 A1 May 18, 2017

(30) Foreign Application Priority Data

Jun. 25, 2014 (FR) ..... 14 55937

(51) Int. Cl.
*F17C 9/00* (2006.01)
*F17C 3/02* (2006.01)
(Continued)

(52) U.S. Cl.
CPC ..... *F17C 3/027* (2013.01); *B63B 25/16* (2013.01); *B63B 27/24* (2013.01); *B67D 9/00* (2013.01);
(Continued)

(58) Field of Classification Search
CPC .... F17C 3/027; F17C 5/02; F17C 6/00; F17C 9/00; F17C 7/02; B63B 25/16; B63B 27/24
See application file for complete search history.

(56) References Cited

U.S. PATENT DOCUMENTS 6,035,795 A * 3/2000 Dhellemmes ..... B63B 25/16 114/74 A
2006/0096235 A1* 5/2006 Dhellemmes ..... B63B 25/16 204/267
(Continued)

FOREIGN PATENT DOCUMENTS

EP 0248721 A1 12/1987
EP 2284072 A2 2/2011
FR 2781557 A1 1/2000

*Primary Examiner* — Stephen P Avila
(74) *Attorney, Agent, or Firm* — Notaro, Michalos & Zaccaria P.C.

(57) ABSTRACT

A sealed insulating tank in which the secondary insulating barrier, the secondary sealing membrane, and the primary insulating barrier essentially consist of a set of prefabricated panels juxtaposed on the supporting structure. Sealing strips are arranged so that they overlap the adjoining edge zones of the leaktight linings of the prefabricated panels in order to complete the secondary sealing membrane between the prefabricated panels. Insulating blocks arranged on the sealing strips have a layer of thermal insulation covered by a rigid board and a reinforcing mat having a stiffness under tension which is greater than or equal to the stiffness under tension of the sealing strips and is glued to the layer of thermal insulation on a face of the layer of thermal insulation opposite the rigid board, the insulating block being each time fixed to the prefabricated panels by gluing the reinforcing mat to the underlying sealing strip.

16 Claims, 3 Drawing Sheets

(51) Int. Cl.

| | |
|---|---|
| ***B63B 25/16*** | (2006.01) |
| ***B63B 27/24*** | (2006.01) |
| ***B67D 9/00*** | (2010.01) |
| ***F17C 5/02*** | (2006.01) |
| ***F17C 6/00*** | (2006.01) |
| ***F17C 7/02*** | (2006.01) |

(52) U.S. Cl.

CPC ..... *F17C 5/02* (2013.01); *F17C 6/00* (2013.01); *F17C 7/02* (2013.01); *F17C 9/00* (2013.01); *F17C 2201/0157* (2013.01); *F17C 2201/052* (2013.01); *F17C 2203/0333* (2013.01); *F17C 2203/0358* (2013.01); *F17C 2203/0624* (2013.01); *F17C 2203/0631* (2013.01); *F17C 2203/0663* (2013.01); *F17C 2205/0352* (2013.01); *F17C 2209/227* (2013.01); *F17C 2221/033* (2013.01); *F17C 2223/0161* (2013.01); *F17C 2223/033* (2013.01); *F17C 2227/0135* (2013.01); *F17C 2260/011* (2013.01); *F17C 2270/0107* (2013.01)

(56) References Cited

U.S. PATENT DOCUMENTS

| | | | | |
|---|---|---|---|---|
| 2009/0223974 | A1* | 9/2009 | Felius | F17C 3/022 220/560.12 |
| 2011/0056954 | A1* | 3/2011 | Joh | B63B 25/16 220/560.07 |
| 2015/0285439 | A1* | 10/2015 | Herry | F17C 3/027 114/74 A |
| 2017/0138537 | A1* | 5/2017 | Sassi | F17C 3/027 |
| 2017/0276295 | A1* | 9/2017 | Herry | F17C 3/027 |

* cited by examiner

SEALED INSULATING TANK AND METHOD OF MANUFACTURING THE SAME

BACKGROUND OF THE INVENTION

The invention relates to the field of sealed insulating tanks capable of containing cold fluids, in particular to tanks for storing or transporting liquefied gas, in particular liquefied natural gas at atmospheric pressure.

PRIOR ART

A sealed insulating tank having a tank wall fixed on a supporting structure, in which the tank wall has a multilayer structure which comprises, successively, a primary sealing membrane intended to be in contact with a product contained in the tank, a primary insulating barrier, a secondary sealing membrane, and a secondary insulating barrier is known, in particular from FR-A-2781557.

The secondary insulating barrier, the secondary sealing membrane, and the primary insulating barrier essentially consist of a set of prefabricated panels fixed on the supporting structure, each prefabricated panel comprising, successively, a rigid base board, a first layer of thermal insulation carried by the base board and forming, with the base board, an element of the secondary insulating barrier, a leaktight lining which completely covers the first layer of thermal insulation, being glued to the first layer of thermal insulation, and which forms an element of the secondary sealing membrane, a second layer of thermal insulation which covers a central zone of the first layer and of the leaktight lining, and a rigid cover board covering the second layer of thermal insulation and forming, with the second layer of thermal insulation, an element of the primary insulating barrier.

The base board, the first layer of thermal insulation and the leaktight lining of the prefabricated panel have a first rectangular contour, whilst the second layer of thermal insulation and the cover board have a second rectangular contour with smaller dimensions than the first rectangular contour, with the result that the second layer of thermal insulation and the cover board do not cover an edge zone of the leaktight lining along the four edges of the first rectangular contour.

The prefabricated panels are juxtaposed on the supporting structure, parallel to one another, so that the edge zone of the leaktight lining of a first prefabricated panel each time adjoins the edge zone of the leaktight lining of a second prefabricated panel.

The wall of the tank furthermore has sealing strips made from a flexible composite laminate material comprising at least one metal sheet bound to at least one fibrous layer, the sealing strips being arranged so that they overlap the adjacent edge zones of the leaktight linings of the prefabricated panels and glued leaktightly to the leaktight linings of the prefabricated panels in order to complete the secondary sealing membrane between the prefabricated panels.

The wall of the tank furthermore has insulating blocks arranged on the sealing strips, an insulating block being each time arranged between the second layers of thermal insulation of two adjoining prefabricated panels so as to complete the primary insulating barrier between the two prefabricated panels, the insulating block having a layer of thermal insulation covered with a rigid board, with the result that the rigid boards of the insulating blocks and the cover boards of the prefabricated panels form a substantially continuous wall capable of supporting the primary sealing membrane.

EP-A-0248721 describes a thermally insulating wall structure of a similar design, in which an interposed packing made from a rigid insulating cellular material fills the gap between two adjacent sandwich panels. The interposed packing is covered by the joint cover strip forming the secondary sealing barrier and is glued to the said joint cover strip. The internal block glued to the joint cover strip is coated on its external face adjacent to the joint cover strip with a glass-fiber fabric glued to the said outer face in order to reinforce the mechanical strength of the block. Given that the block is glued against the base formed by the shoulders of the sandwich panels and by the interposed packing, the glass-fiber fabric of the block is glued to the joint cover strip also in the central portion of the joint cover strip covering the interposed packing.

BRIEF DESCRIPTION OF THE INVENTION

In the tanks of the abovementioned type, deformations occur in all the elements owing to the changes in temperature affecting the tank wall when the tank is filled with a very cold liquid such as LNG and, conversely, when it is emptied, which entails a return to room temperature. In addition to these thermal contraction and expansion effects, which recur over time during the lifetime of the tank, tanks of vessels are also subjected to forces caused by the deformation of the hull of the vessel when at sea. This results in fatigue phenomena in the elements, which need to be monitored over time in order to prevent any rupture.

One idea on which the invention is based is to reinforce the fatigue strength of the secondary sealing membrane of a tank of the abovementioned type, in particular in the region of the sealing strips arranged so that they overlap the edge zones of the prefabricated panels. Indeed, owing to the flexibility of the material used, in other words the capacity of the material to be bent to form waves without breaking, the sealing strips are particularly subject to deformations during the lifetime of the tank.

In order to do this, the invention provides a tank of the abovementioned type, characterized in that the insulating block has a reinforcing mat made from a composite material comprising a layer of fibers bound together by a polymeric resin, the reinforcing mat having a stiffness under tension which is greater than or equal to the stiffness under tension of the sealing strips, the reinforcing mat being glued to the layer of thermal insulation on a face of the layer of thermal insulation opposite the rigid board, the insulating block being each time fixed to the prefabricated panels by gluing the reinforcing mat to the underlying sealing strip.

By virtue of these features, the fatigue strength of the secondary membrane can be increased, whilst preserving a sealing strip as a flexible mat between the panels, which has advantages for the reliability and sealing effect of the gluing of the sealing strip to the leaktight linings of the prefabricated panels and, when necessary, for the ability of the secondary membrane to move in response to the thermally provoked movements.

Owing to the fact that the reinforcing mat is made from a composite material having a stiffness under tension which is greater than or of the same magnitude as the stiffness under tension of the sealing strips, and to the fact that the reinforcing mat comprises a fibrous layer impregnated with a polymeric resin, it is possible to effectively absorb the tensile forces which occur substantially parallel to the tank wall from the thermal contraction and/or deformation of the supporting structure when the vessel is at sea. Furthermore, the choice of a fibrous composite material limits the thermal stress generated by the reinforcing mat.

In order to influence the stiffness under tension of the reinforcing mat, the following properties of the reinforcing mat can in particular be selected:

type of polymeric resin, Young's modulus in the final state type and diameter of the fibers.

According to embodiments, such a tank can have one or more of the following features.

Another desirable physical property for the reinforcing strip is the relatively low thermal expansion coefficient, which can be obtained by the choice of fibers, for example glass fibers, carbon fibers, polyester fibers, etc.

Another desirable physical property for the reinforcing strip is good gluability, which can be obtained in particular by the choice of the resin, which can be chosen, for example, from the group consisting of polyamides, polyether terephthalate, polyesters, polyurethanes, epoxy and mixtures thereof. On the other hand, polyethylene and polypropylene resins are more difficult to glue reliably unless they have received a required specific treatment.

The material of the reinforcing mat preferably has a thermal expansion coefficient a and a Young's modulus under tension E, measured at 23° C., such that the following is true for their product:

$$7.10^4\ \mathrm{Pa{\cdot}K^{-1}} < E.\alpha < 10^6\ \mathrm{Pa{\cdot}K^{-1}}$$

By way of example, flexible composite materials such as Triplex® ($E.\alpha \sim 88000$) are suitable for the reinforcing mat. For a higher value than approximately $10^6$ $\mathrm{Pa{\cdot}K^{-1}}$, for example in the case of a metal sheet, the thermal strain in the material during cooling would be too high. For a lower value than approximately $7.10^4$ $\mathrm{Pa{\cdot}K^{-1}}$, for example in the case of plywood ($E.\alpha \sim 48000$), the rigidity would not be sufficient to effectively reinforce the sealing strip in the form of a flexible mat.

The Young's modulus under tension E, determined according to the NF EN ISO 1421 method or using extensometers, can be used to determine the rigidity under tension of the reinforcing mat. The thermal contraction coefficient a can be determined by an optical system or a comparator system mounted on an invar frame in order to have a virtually zero contribution of the frame.

The flexible composite laminate material of the sealing strip can be made in different ways in terms of the composition, the number and arrangement of the layers, in particular with one or more metal layers and one or more fibrous layers. According to an embodiment, the sealing strip consists of a flexible composite laminate material comprising a metal sheet sandwiched between two layers of glass fibers. For example, the metal sheet is made from aluminum. The two layers of glass fibers are bound to the metal sheet by a flexible polymeric resin, for example an elastomer or polyurethane.

According to an embodiment, the reinforcing mat is made from a flexible composite laminate material comprising at least one metal sheet bound to at least one fibrous layer, for example of the same flexible composite laminate material as the sealing strip. The use of the same flexible composite laminate material for the sealing strips and the reinforcing mat facilitates the supply and quality control of the materials.

According to an embodiment, the leaktight lining of the prefabricated panels is made from a flexurally rigid composite laminate material comprising a metal sheet sandwiched between two layers of glass fibers, the two layers of glass fibers being impregnated with a rigid polymeric resin. The metal sheet is made, for example, from aluminum.

According to a preferred embodiment, the reinforcing mat is made from a material which is stiffer under tension than the sealing strips. In order to do this, a flexurally rigid composite material comprising a layer of fibers impregnated with a rigid polymeric resin, for example polyamide, polyether terephthalate, polyester, polyurethane, epoxy and mixtures thereof can be used. The use of a material which is stiffer under tension than the flexible leaktight mat of the sealing strips makes it possible to effectively absorb more tensile force which occurs substantially parallel to the tank wall by thermal contraction and/or deformation of the supporting structure when the vessel is at sea.

According to an embodiment, the same rigid composite laminate material can be used for the leaktight lining and the reinforcing mat, which facilitates the supply and quality control of the materials.

According to an embodiment, the tank wall has a gap located between the first layers of thermal insulation of two adjoining prefabricated panels and a blocking strip of material arranged in the gap, the sealing strip which completes the secondary sealing membrane between the prefabricated panels has a central portion which bridges the gap above the blocking strip of material, the central portion of the sealing strip not being glued to the blocking strip of material, and the reinforcing mat has a central portion covering the central portion of the sealing strip and not being glued to the central portion of the sealing strip.

By virtue of these features, the central portion of the sealing strip has a greater flexibility and greater mobility in order to absorb displacement caused by the thermal contraction and/or the deformation of the vessel when at sea.

According to embodiments, a central pad of non-adhesive material can be fixed to the flexible sealing mat or to the reinforcing mat. The pad can be fixed in different manners, in particular by double-sided adhesive or with an adhesive strip. Such a pad can be made from different materials, for example flexible foam of the elastomer, polyurethane, polyolef in (polyethylene, polypropylene) or melamine type.

According to a corresponding embodiment, the insulating block furthermore has a central pad made from non-adhesive material fixed so that it projects from a surface of the reinforcing mat opposite the layer of thermal insulation of the insulating block, the insulating block being arranged on the sealing strip in such a way that the central pad covers the central portion of the sealing strip.

According to another corresponding embodiment, the sealing strip furthermore has a central pad made from non-adhesive material fixed so that it projects from a surface of the sealing strip facing the insulating block, the insulating block being arranged on the sealing strip in such a way that the central portion of the reinforcing mat covers the central pad without being glued to the central pad.

Different materials can be suitable for the layers of thermal insulation of the prefabricated panels and of the insulating blocks. The polyurethane foams are particularly appropriate materials owing to their resistance to low temperatures and their poor thermal conductivity. The polyurethane foam is preferably reinforced with embedded fibers, for example glass fibers.

According to an embodiment, the thermal insulation is made from a polyurethane foam having a density greater than 130 $\mathrm{kg/m^3}$, for example between 130 and 210 $\mathrm{kg/m^3}$.

By virtue of these features, the rigidity and durability of the insulating barriers can be increased.

Such a tank can be part of an onshore storage installation, for example for storing LNG or to be installed in a floating structure in coastal regions or in deep water, in particular an LNG carrier, a floating storage and regasification unit (FSRU), a floating production, storage and offloading unit (FPSO), etc.

According to an embodiment, a vessel for transporting a cold liquid product has a double hull and an abovementioned tank arranged in the double hull.

According to an embodiment, the invention also provides a method for loading or unloading such a vessel, in which a cold liquid product is conveyed through insulated pipelines from or to a floating or onshore storage installation to or from the tank of the vessel.

According to an embodiment, the invention also provides a transfer system for a cold liquid product, the system comprising the abovementioned vessel insulated pipelines arranged so as to connect the tank installed in the hull of the vessel to a floating or onshore storage installation and a pump for forcing a flow of cold liquid product through the insulated pipelines from or to the floating or onshore storage installation to or from the tank of the vessel.

According to an embodiment, the invention also provides a method for manufacturing a sealed insulating tank, the method comprising:

providing a set of prefabricated panels, each prefabricated panel comprising, successively, a rigid base board, a first layer of thermal insulation carried by the base board and forming, with the base board, an element of the secondary insulating barrier, a leaktight lining which completely covers the first layer of thermal insulation being glued to the first layer of thermal insulation and which forms an element of the secondary sealing membrane, a second layer of thermal insulation which covers a central zone of the first layer and the leaktight lining, and a rigid cover board covering the second layer of thermal insulation and forming, with the second layer of thermal insulation, an element of the primary insulating barrier, the base board, the first layer of thermal insulation and the leaktight lining of the prefabricated panel having a first rectangular contour, whilst the second layer of thermal insulation and the cover board have a second rectangular contour of smaller dimensions than the first rectangular contour, with the result that the second layer of thermal insulation and the cover board do not cover an edge zone of the leaktight lining along the four edges of the first rectangular contour, juxtaposing and fixing the prefabricated panels parallel to one another on the supporting structure in such a way that the edge zone of the leaktight lining of a first prefabricated panel each time adjoins the edge zone of the leaktight lining of a second prefabricated panel, arranging sealing strips so that they overlap the adjoining edge zones of the leaktight linings of the prefabricated panels, the sealing strips being made from a flexible composite laminate material comprising at least one metal sheet bound to at least one fibrous layer and gluing the sealing strips leaktightly to the leaktight linings of the prefabricated panels in order to complete the secondary sealing membrane between the prefabricated panels, providing insulating blocks, the insulating panel having a layer of thermal insulation, a rigid board fixed to an upper face of the layer of thermal insulation and a reinforcing mat made from a composite material comprising a layer of fibers bound together by a polymeric resin, the reinforcing mat having a stiffness under tension which is greater than or equal to the stiffness under tension of the sealing strips, the reinforcing mat being glued to a lower face of the layer of thermal insulation opposite the rigid board, arranging the insulating blocks on the sealing strips, an insulating block being each time arranged between the second layers of thermal insulation of two adjoining prefabricated panels in such as way as to complete the primary insulating barrier between the two prefabricated panels and to form a support wall which is substantially continuous with the rigid boards of the insulating blocks and the cover boards of the prefabricated panels, fixing the insulating blocks to the prefabricated panels by gluing the reinforcing mat of the insulating block to the underlying sealing strip, and fixing a primary sealing membrane to the substantially continuous support wall.

According to some embodiments, this method can have one or more of the following features.

According to an embodiment, the method furthermore comprises:

arranging a blocking strip of material in a gap located between the first layers of thermal insulation of two adjoining prefabricated panels, arranging the sealing strip which completes the secondary sealing strip between the prefabricated panels without gluing to the blocking strip of material a central portion of the sealing strip which bridges the gap above the blocking strip of material, and fixing the insulating block having the reinforcing mat without gluing a central portion of the reinforcing mat to the sealing strip.

According to an embodiment, the insulating block furthermore has a central pad made from non-adhesive material fixed so that it projects from a surface of the reinforcing mat opposite the layer of thermal insulation of the insulating block, the method furthermore comprising the step of gluing the reinforcing mat of the insulating block on either side of the central pad without gluing the central pad, and of arranging the insulating block on the sealing strip in such a way that the central pad covers the central portion of the sealing strip without adhering to it.

According to another embodiment, the sealing strip furthermore has a central pad made from non-adhesive material fixed so that it projects from a surface of the sealing strip facing the insulating block, the method furthermore comprising the step of gluing the sealing strip on either side of the central pad without gluing the central pad, and of arranging the insulating block on the sealing strip in such a way that the central portion of the reinforcing mat covers the central pad without being glued to the central pad.

BRIEF DESCRIPTION OF THE DRAWINGS

The invention will be better understood, and other objects, details, features, and advantages of it will become more clearly apparent in the course of the following description of several particular embodiments of the invention, given purely by way of illustration and with no limitation being implied, with reference to the attached drawings.

DETAILED DESCRIPTION OF EMBODIMENTS OF THE INVENTION

Figure 1:
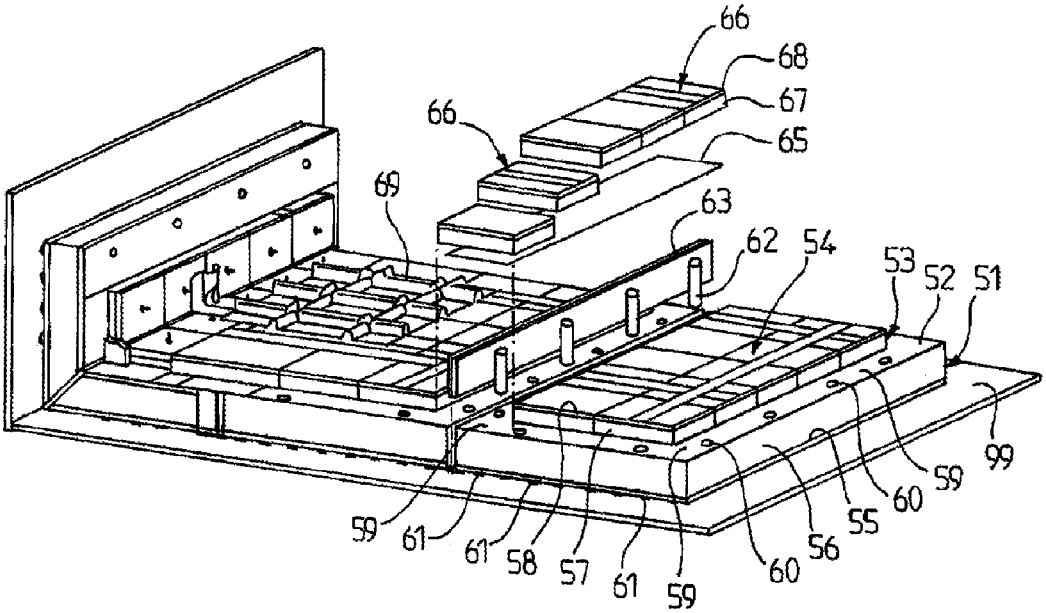
FIG. 1 is a partially exploded perspective view of a tank wall according to an embodiment.

With reference to FIG. 1, an embodiment of a tank wall is now described in which the secondary insulating barrier, the secondary sealing membrane and the primary insulating barrier are made from prefabricated panels 54.

Such a wall structure can be used to make substantially all the walls of a polyhedral tank. In this respect, the terms "on", "above", "upper" and "high" generally refer to a position situated towards the inside of the tank and thus do not necessarily coincide with the notion of being high in the Earth's gravitational field. Similarly, the terms "under", "below", "lower" and "low" generally refer to a position situated toward the outside of the tank and thus do not necessarily coincide with the notion of being low in the Earth's gravitational field.

The prefabricated panels 54 are fixed to the supporting structure in a juxtaposed fashion according to a repeated pattern. A panel 54 each time has an element of the secondary insulating barrier 51, an element of the secondary leaktight barrier, and an element of the primary insulating barrier 53.

A panel 54 has substantially the form of a rectangular parallelepiped. It consists of a first board 55 of 9 mm thick plywood surmounted by a first layer of thermal insulation 56 which is itself surmounted by a rigid leaktight lining 52 including a 0.07 mm thick aluminum sheet sandwiched between two pieces of fabric of glass fibers impregnated with a polyamide resin. The leaktight lining 52 is glued to the layer of thermal insulation 56, for example with the aid of a two-component polyurethane glue.

A second layer of thermal insulation 57 is glued to the leaktight lining 52 and itself carries a second 12 mm thick plywood board. The sub-assembly 55-56 forms the secondary insulation barrier element 51. The sub-assembly 57-58 forms the primary insulation barrier element 53 and it has, in a plan view, a rectangular form, the sides of which are parallel to those of the secondary insulation barrier 51. The two insulation barrier elements have, in plan view, the form of two rectangles with the same center. The element 53 leaves uncovered a peripheral edge surface 59 of the leaktight lining 52 around the whole element 53. The leaktight lining 52 forms the secondary sealing membrane element 52.

The panel 54 which has just been described can be prefabricated to form an assembly, the different constituents of which are glued to one another in the arrangement indicated above. This assembly thus forms the secondary barriers and the primary insulation barrier. The layers of thermal insulation 56 and 57 can be made from a honeycomb plastic material such as polyurethane foam. Glass fibers are preferably embedded in the polyurethane foam in order to reinforce it.

In order to fix the panels 54 to the supporting structure 99, holes 60, regularly distributed over the two longitudinal edges of the panel, are provided to interact with pins fixed to the supporting structure 99 according to a known technique.

The supporting structure 99, in particular in the case of a vessel, has variances with respect to the theoretical surface provided for the supporting structure simply as a result of manufacturing inaccuracies. In a known fashion, these variances are compensated by applying the panels 54 against the supporting structure via beads of polymerizable resin 61 which make it possible, from an imperfect supporting structure surface, to obtain a cladding consisting of adjacent panels 54 having second boards 58 which, as a whole, define a surface with virtually no variance with respect to the desired theoretical surface.

The holes 60 are filled by inserting plugs of thermal insulating material 62 therein, these plugs being flush with the level of the first layer of thermal insulation 56 of the panel 54. A thermal insulation material 63 consisting, for example, of a sheet of plastic foam or glass wool inserted in the gap can furthermore be placed in the gaps which separate the elements 51 of two adjacent panels 54.

In order to form a continuous secondary sealing membrane, a flexible leaktight strip 65 is placed on the adjoining peripheral edges 59 of two adjacent panels 54 and the leaktight strip 65 is glued to the peripheral edges 59 so as to block the perforations situated at right angles to each hole 60 and cover the gap between the two panels 54. The leaktight strip 65 is made from a flexible composite material called Triplex® having three layers: the two outer layers are pieces of glass-fiber fabric and the intermediate layer is a thin metal sheet, for example an approximately 0.1 mm thick aluminum sheet. This metal sheet ensures the continuity of the secondary sealing membrane. Its flexibility when bent, owing to the flexible nature of the binding material between the aluminum sheet and the glass fibers, allows it to follow the deformations of the panels 54 caused by the deformation of the hull in a swell or the cooling of the tank. Flexibility when bent is understood to mean the capacity of the material to be bent to form waves without breaking.

A depressed zone situated at right angles to the peripheral edges 59 exists between the elements 53 of two panels 54, the depth of this depression being substantially the thickness of the primary insulation barrier. These depressed zones are filled by placing therein insulating blocks 66 each consisting of a layer of thermal insulation 67 covered with a rigid plywood board 68 on an upper surface of the insulating block 66 and with a reinforcing mat on the lower surface of the insulating block 66. The reinforcing mat, not visible in FIG. 1, will be described with reference to FIGS. 2 to 4.

The insulating blocks 66 have a size such that they fill all of the zone situated above the peripheral edges 59 of two adjacent panels 54. The insulating blocks 66 are glued to the leaktight strips 65. After they have been put in place, the board 68 ensures relative continuity between the boards 58 of two adjacent panels 54 to support the primary sealing membrane.

These insulating blocks 66 have a width equal to the distance between two elements 53 of two adjacent panels 54 and can have a greater or lesser length. A short length, when appropriate, makes placing easier in the event of a slight misalignment between two adjacent panels 54. The blocks 66 are glued to the leaktight strip 65, pressed against the latter.

The primary sealing membrane is formed from a membrane of corrugated metal sheets 69 having two series of intersecting undulations in order to give it sufficient flexibility in both directions of the plane of the tank wall.

In FIG. 1, the insulating blocks 66, the leaktight strip 65 and the thermal insulation materials 62 and 63 are shown in an exploded view and hence appear above their actual position in the tank wall in the final assembled state. The final positions of these elements can be better seen in FIG. 3 which will be described below.

Figure 2:
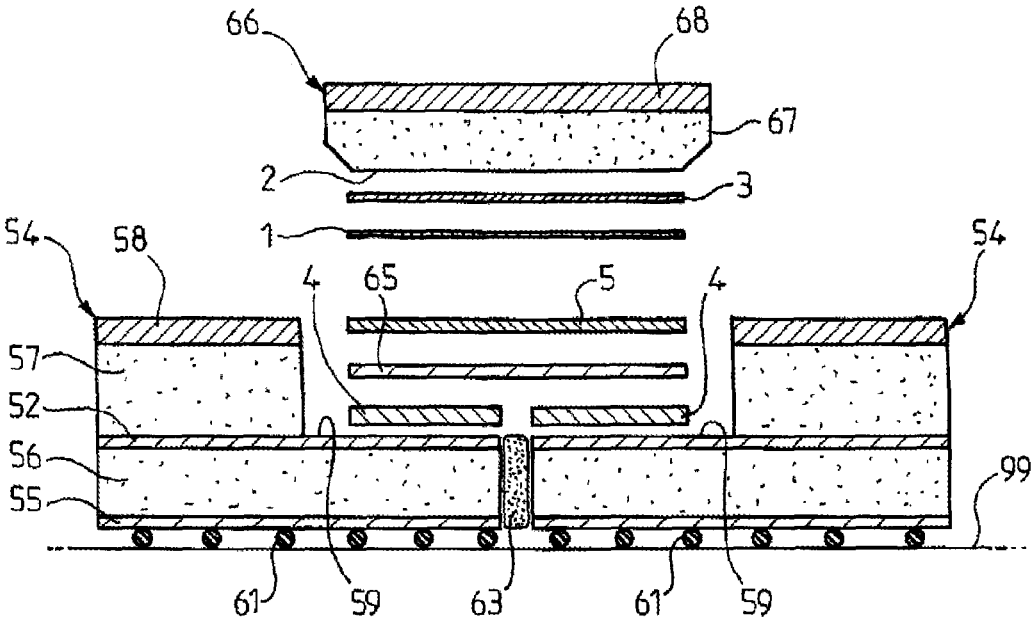
FIG. 2 is a plane exploded view of a zone of the tank wall of FIG. 1 situated at the interface between two prefabricated panels.
Figure 3:
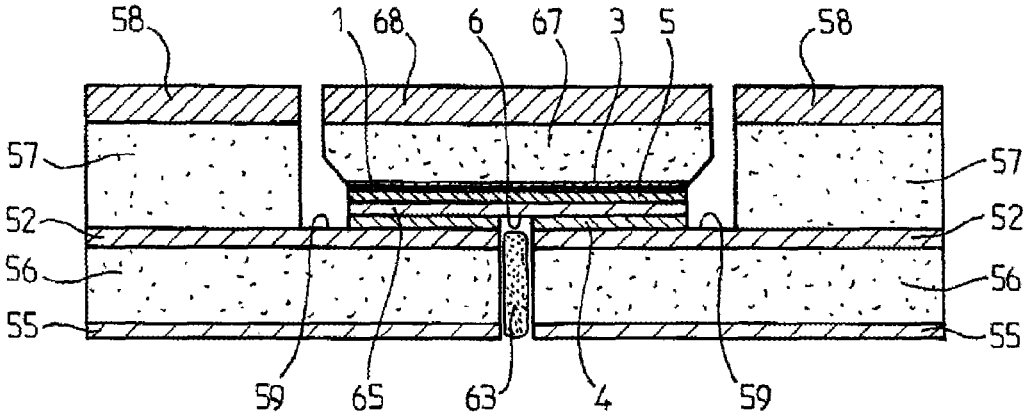
FIG. 3 is a view similar to FIG. 2 showing the zone of the tank wall in the assembled state.

With reference to FIGS. 2 and 3, a first embodiment of the tank wall in the region of the join between two prefabricated panels 54 will now be described. FIG. 2 shows partially the two prefabricated panels 54 fixed on top of the supporting structure 99 in their final position, whilst the insulating block 66, the reinforcing mat 1 of the insulating block 66 and the leaktight strip 65 are shown in the disassembled state above their final position. FIG. 3 shows all the elements in their final assembled position. The thicknesses of the leaktight lining 52, the leaktight strip 65, the reinforcing mat 1, and the corresponding layers of glue have been exaggerated for the sake of greater visibility.

The reinforcing mat 1 is glued on top of the lower surface 2 of the layer of thermal insulation 67 by means of a layer of glue 3. This glue can be applied in a prior manufacturing stage so that an insulating block 66 already having the reinforcing mat 1 can be supplied to site where the tank is assembled. The glue is, for example, an epoxy or polyurethane glue.

The assembly method is as follows:

- A layer of glue 4 is arranged on the peripheral edge surface 59 of the leaktight lining 52 of the two prefabricated panels 54.
- The leaktight strip 65 is then applied and pressed onto the layer of glue 4 until the glue sets. The glue 4 is, for example, an epoxy or polyurethane glue. As can be seen in FIG. 3, the leaktight strip 65 is not glued in the region of a central portion 6 of its lower surface which bridges the gap between the two panels 54, said gap measuring approximately 30 mm.
- A second layer of glue 5 is then arranged either on the lower surface of the reinforcing mat 1 of the insulating block 66 or on the upper surface of the leaktight strip 65.
- Lastly, the insulating block 66 is applied and pressed against the upper surface of the leaktight strip 65 until the glue 5 sets.

The glue 5 is, for example, a relatively viscous epoxy or polyurethane glue, which allows a relatively thick layer to be applied in order to compensate the surface irregularities of the reinforcing mat 1. It is indeed important that, in the assembled state, the rigid boards 68 and 58 overall provide a very flat supporting surface in order to uniformly support the primary sealing membrane 69 which is made from a thin and relatively fragile material.

The layer of glue 5 is preferably not applied perpendicularly to the central portion 6 of the leaktight strip 65 so as to preserve the elasticity and mobility of this central portion 6 by applying no glue to either of its faces.

Figure 4:
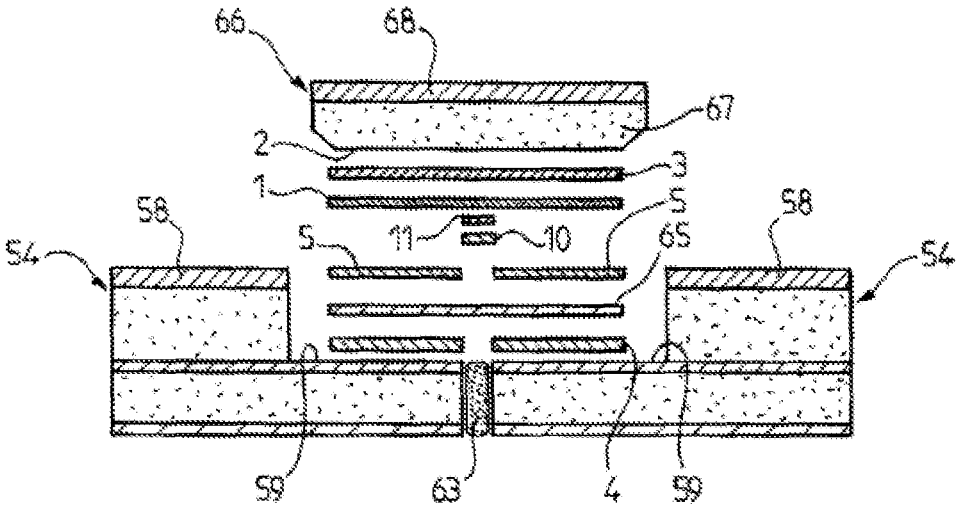
FIG. 4 is a view similar to FIG. 2 showing another embodiment of the zone of the wall situated at the interface between two prefabricated panels.

FIG. 4 shows a second embodiment of the tank wall in the region of the join between two prefabricated panels 54, in which the insulating block has been modified so that the layer of glue 5 is not applied perpendicularly to the central portion 6 of the leaktight strip 65. Elements that are identical or similar to those in the previous embodiment have the same reference numerals.

In FIG. 4, the insulating block 66 additionally has a non-adhesive pad 10, made for example from polymeric foam or thick paper, which is glued to the lower surface of the reinforcing mat 1, in the region of a center line of the insulating block 66 intended to cover the central portion 6 of the leaktight strip 65. The pad 10 can be glued to the reinforcing mat 1 in different fashions, for example by means of a line of glue 11 or double-sided Scotch tape or by providing the pad 10 with an adhesive strip. The pad 10 can also be assembled in a prior manufacturing stage in order to minimize the operations which need to be performed on the assembly site of the tank.

In order to fix the insulating block 66 to the tank wall, the layer of glue 5 is applied to the lower surface of the reinforcing mat 1 on either side of the non-adhesive pan 10, without applying any glue to the non-adhesive pad 10. Thus, once the final assembly is complete, the upper surface of the central portion 6 of the leaktight strip 65 is in contact with the non-adhesive pad 10 but is not glued to it, which assists its flexibility and mobility in order to absorb thermally generated displacements.

In an embodiment not shown in FIG. 4 but which constitutes an alternative, the pad 10 is fixed not to the reinforcing mat 1 but to the flexible mat 65, for example with double-sided Scotch tape or an adhesive strip in order to position it.

Figure 5:
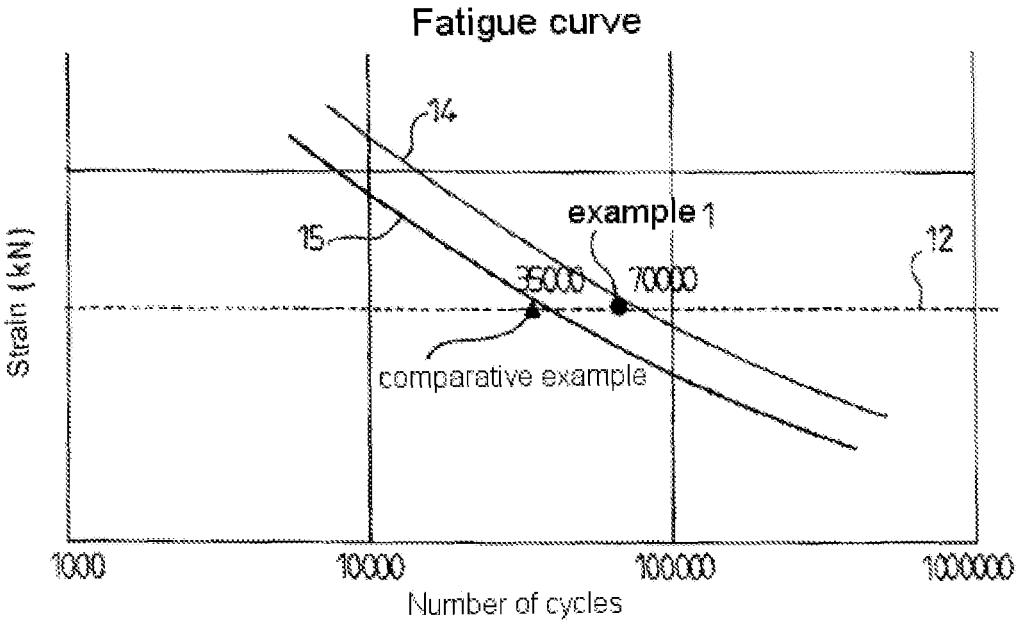
FIG. 5 is a fatigue curve showing the breaking strain of the secondary membrane as a function of a number of cooling/heating cycles, for different embodiments of the insulating block.

Exemplary embodiments of the tank wall will now be described by way of illustration and their mechanical fatigue-resistance properties will be described with reference to FIG. 5. FIG. 5 shows the breaking strain of the sealing strip 65 expressed in kilonewtons (kN) as a function of the average service life of the tank wall, expressed as an average number of cycles under tension when cold.

EXAMPLE 1

The thermal insulation of the layers 56, 57 and 67 is a 130 kg/m$^3$ dense polyurethane foam reinforced with glass fibers. The thickness of the primary insulating barrier is 150 mm. The thickness of the secondary insulating barrier is 250 mm. The service temperature of the secondary membrane is approximately −80° C.

The leaktight strip 65 is a flexible Triplex® with a thickness equal to 0.6 mm (aluminum, resin, glass fiber) supplied by the Hutchinson company. The width of this strip is of the order of 250 mm. Its Young's modulus under tension is E=10 GPa and its coefficient of thermal expansion at 23° C. is $\alpha=0.9.10^{-5}K^{-1}$. The tensile breaking strain, measured at 23° C., is approximately 200 MPa. This material is usually packaged in rolls owing to its flexibility.

The glue 4 is a two-component polyurethane glue supplied by the Bostik company under the reference number XPU 18411 A/3B.

The reinforcing mat 1 is rigid Triplex with a thickness equal to 0.6 mm (aluminum, glass fiber, polyamide resin) supplied by the Hankuk company. Its Young's modulus under tension is E=15 GPa and its coefficient of thermal expansion at 23° C. is $\alpha=10^{-5}$ $K^{-1}$. The tensile breaking strain, measured at 23° C., is approximately 210 MPa. The central portion of the reinforcing mat 1 is also glued to the leaktight strip 65. This material is usually packaged in flat panels owing to its relative rigidity.

The glue 3 is a two-component polyurethane glue supplied by the Henkel company under the reference number Macroplast 8202/5400.

The glue 5 is an epoxy resin supplied by the Unitech company under the reference number UEA 100/300.

An endurance test is carried out in the form of a succession of cooling/heating cycles between room temperature and the temperature of the LNG (−162° C.). The leaktight strip 65 holds for 70,000 cycles before exceeding a benchmark strain threshold shown by the line 12 in FIG. 5. This threshold corresponds to the breaking of a material of the insulation assembly.

The curve 14 in FIG. 5 is an average fatigue curve for the leaktight strip 65.

Moreover, in this configuration, a digital simulation of the tank wall at the service temperature predicts a tensile strain in the leaktight strip 65 of the order of 63 MPa, which is considerably below the breaking strain of the flexible Triplex® which is close to 200 MPa.

COMPARATIVE EXAMPLE 1

The reinforcing mat 1 and the layer of glue 3 have been removed. Otherwise, the data in example 1 are repeated. The leaktight strip 65 holds for 35,000 cycles before exceeding the benchmark strain threshold shown by the line 12 in FIG. 5.

The curve 15 in FIG. 5 is an average fatigue curve for the leaktight strip 65 resulting from the extrapolation of the comparative example 1. The service life of the leaktight strip 65 obtained in the comparative example 1 is less than 50% of the service life obtained in example 1.

Moreover, in this configuration, a digital simulation of the tank wall at the service temperature predicts a tensile strain in the leaktight strip 65 of the order of 117 MPa.

EXAMPLE 2

The strengthening layer 1 is flexible Triplex® of a thickness equal to 0.6 mm (aluminum, glass fiber) supplied by the Hutchinson company. Its Young's modulus under tension is E=10 GPa and its coefficient of thermal expansion at 23° C. is $\alpha=0.9.10^{-5}K^{-1}$. The tensile breaking strain, measured at 23° C., is approximately 200 MPa.

Otherwise, the data from example 1 are repeated.

A digital simulation of the tank wall at the service temperature predicts a tensile strain in the leaktight strip 65 of the order of 74 MPa, which is also considerably below the breaking strain of flexible Triplex®, which is close to 200 MPa.

The above described technique for producing a tank wall can be used in different types of containments, for example to form an LNG containment in an onshore installation or in a floating structure such as an LNG carrier or the like.

Figure 6:
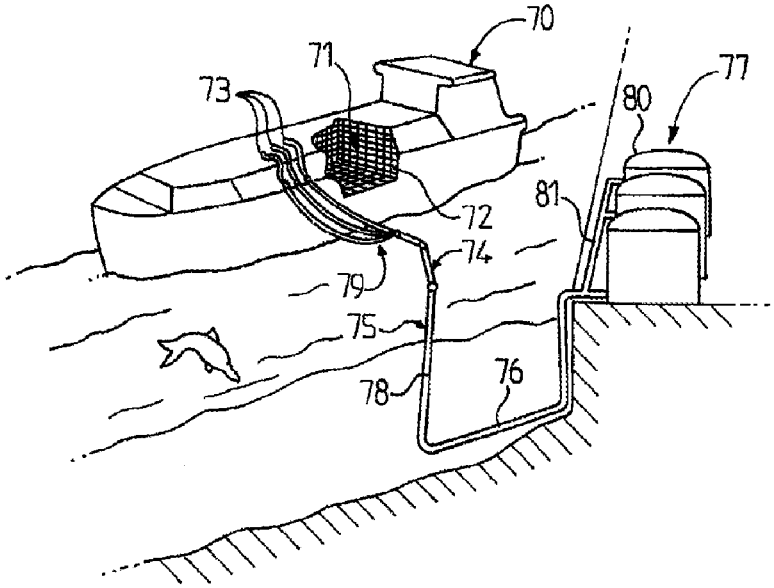
FIG. 6 is a cutaway schematic representation of an LNG carrier tank and a terminal for loading/unloading this tank.

With reference to FIG. 6, a cutaway view of an LNG carrier 70 shows a leaktight insulated tank 71 with a general prismatic shape in the double hull 72 of the vessel. The wall of the tank 71 has a primary leaktight membrane intended to be in contact with the LNG contained in the tank, a secondary leaktight membrane arranged between the primary leaktight membrane and the double hull 72 of the vessel, and two insulating barriers arranged respectively between the primary leaktight membrane and the secondary leaktight membrane and the double hull 72.

In a manner known per se, loading/unloading pipelines 73 arranged on the top deck of the vessel can be connected, by means of appropriate connectors, to a marine or port terminal in order to transfer a cargo of LNG from or to the tank 71.

FIG. 6 shows an example of a marine terminal having a loading and unloading station 75, an under-sea pipe 76 and an onshore installation 77. The loading and unloading station 75 is a fixed offshore installation having a movable arm 74 and a tower 78 which supports the movable arm 74. The movable arm 74 carries a bundle of insulated flexible hoses 79 which can be connected to the loading/unloading pipelines 73. The slewable movable arm 74 can be adapted to all sizes of LNG carriers. A connecting pipe (not shown) runs inside the tower 78. The loading and unloading station 75 makes it possible to load and unload the LNG carrier 70 from or to the onshore installation 77. The latter has tanks for storing liquefied gas 80 and connecting pipes 81 joined by the under-sea pipe 76 to the loading or unloading station 75. The under-sea pipe 76 makes it possible to transfer the liquefied gas between the loading or unloading station 75 and the onshore installation 77 over a great distance, for example 5 km, which makes it possible to keep the LNG carrier 70 a long way off the coast during the loading and unloading operations.

Pumps on board the vessel 70 and/or pumps with which the onshore installation 77 is equipped and/or pumps with which the loading and unloading station 75 is equipped are used to generate the pressure required to transfer the liquefied gas.

Although the invention has been described in connection with several particular embodiments, it is of course clear that it is no way limited thereby and that it comprises all the technical equivalents of the means described and combinations thereof if the latter fall within the scope of the invention.

The use of the verbs "have", "comprise" or "include" and their conjugated forms do not exclude the presence of different elements or steps than those mentioned in a claim. The use of the indefinite article "a" or "an" for an element of step does not exclude, unless stated otherwise, the presence of multiple such elements or steps.

In the claims, any reference numeral in brackets should not be interpreted as implying a limitation on the claim.

The invention claimed is:

1. A sealed insulating tank having a tank wall fixed on a supporting structure (99), in which the tank wall has a multilayer structure which comprises, successively, a primary sealing membrane (69) intended to be in contact with a product contained in the tank, a primary insulating barrier, a secondary sealing membrane, and a secondary insulating barrier, in which the secondary insulating barrier, the secondary sealing membrane, and the primary insulating barrier essentially consist of a set of prefabricated panels (54) fixed on the supporting structure, each prefabricated panel comprising, successively, a rigid base board (55), a first layer of thermal insulation (56) carried by the base board and forming, with the base board, an element of the secondary insulating barrier, a leaktight lining (52) which completely covers the first layer of thermal insulation, being glued to the first layer of thermal insulation, and which forms an element of the secondary sealing membrane, a second layer of thermal insulation (57) which covers a central zone of the first layer and of the leaktight lining, and a rigid cover board (58) covering the second layer of thermal insulation and forming, with the second layer of thermal insulation, an element of the primary insulating barrier, in which the base board, the first layer of thermal insulation and the leaktight lining of the prefabricated panel have a first rectangular contour, whilst the second layer of thermal insulation and the cover board have a second rectangular contour with smaller dimensions than the first rectangular contour, with the result that the second layer of thermal insulation and the cover board do not cover an edge zone (59) of the leaktight lining along the four edges of the first rectangular contour, and in which the prefabricated panels are juxtaposed on the supporting structure, parallel to one another, so that the edge zone of the leaktight lining of a first prefabricated panel each time adjoins the edge zone of the leaktight lining of a second prefabricated panel, the wall of the tank furthermore has sealing strips (65) made from a flexible composite laminate material comprising at least one metal sheet bound to at least one fibrous layer, the sealing strips being arranged so that they overlap the adjoining edge zones (59) of the leaktight linings of the prefabricated panels (54) and glued leaktightly to the leaktight linings (52) of the prefabricated panels in order to complete the secondary sealing membrane between the prefabricated panels, the wall of the tank furthermore has insulating blocks (66) arranged on the sealing strips, an insulating block being each time arranged between the second layers of thermal insulation of two adjoining prefabricated panels so as to complete the primary insulating barrier between the two prefabricated panels, the insulating block having a layer of thermal insulation (67) covered with a rigid board (68), with the result that the rigid boards of the insulating blocks and the cover boards of the prefabricated panels form a substantially continuous wall capable of supporting the primary sealing membrane, in which the insulating block has a reinforcing mat (1) comprising a layer of fibers, the reinforcing mat being glued to the layer of thermal insulation on a face of the layer of thermal insulation (67) opposite the rigid board (68), the insulating block being each time fixed to the prefabricated panels by gluing the reinforcing mat (1) to the underlying sealing strip (65), characterized in that the reinforcing mat consists of a composite laminate material comprising at least one metal sheet sandwiched between two layers of glass fibers bound together by a polymeric resin, and in that the reinforcing mat has a stiffness under tension which is greater than or equal to the stiffness under tension of the sealing strips (65).

2. The tank as claimed in claim 1, in which the material of the reinforcing mat has a coefficient of thermal expansion a and a Young's modulus under tension E, measured at 23° C., such that the following is true of their product:

$$7.10^4 Pa \cdot K^{-1} < E.\alpha < 10^6 Pa \cdot K^{-1}.$$

3. The tank as claimed in claim 1, in which the composite laminate material forming the reinforcing mat (1) is flexible.

4. The tank as claimed in claim 1, in which the composite laminate material forming the reinforcing mat (1) is flexurally rigid, the said layers of glass fibers being impregnated with a rigid polymeric resin.

5. The tank as claimed in claim 1 in which the sealing strip (65) consists of a flexible composite laminate material comprising a metal sheet sandwiched between two layers of glass fibers, and in which the leaktight lining (52) of the prefabricated panels consists of a flexible composite laminate material comprising a metal sheet sandwiched between two layers of glass fibers, the two layers of glass fibers being impregnated with a rigid polymeric resin, the reinforcing mat being made from the same material as the sealing strip (65) or the leaktight lining (52).

6. The tank as claimed in claim 1, in which the tank wall has a gap located between the first layers of thermal insulation of two adjoining prefabricated panels (54) and a blocking strip of material (63) arranged in the gap, the sealing strip (65) which completes the secondary sealing membrane between the prefabricated panels has a central portion (6) which bridges the gap above the blocking strip of material, the central portion of the sealing strip not being glued to the blocking strip of material and in which the reinforcing mat (1) has a central portion covering the central portion of the sealing strip and not being glued to the central portion (6) of the sealing strip.

7. The tank as claimed in claim 6, in which the insulating block furthermore has a central pad (10) made from non-adhesive material fixed so that it projects from a surface of the reinforcing mat opposite the layer of thermal insulation of the insulating block, the insulating block being arranged on the sealing strip in such a way that the central pad covers the central portion (6) of the sealing strip (65).

8. The tank as claimed in claim 6, in which the sealing strip furthermore has a central pad (10) made from non-adhesive material fixed so that it projects from a surface of the sealing strip facing the insulating block, the insulating block being arranged on the sealing strip in such a way that the central portion of the reinforcing mat (1) covers the central pad without being glued to the central pad.

9. The tank as claimed in claim 1, in which the first layer of thermal insulation of the prefabricated panel, the second layer of thermal insulation of the prefabricated panel, and the layer of thermal insulation of the insulating block are made from a polyurethane foam having a density greater than 130 kg/mp3, for example between 130 and 210 kg/m3.

10. A vessel (70) for transporting a cold liquid product, the vessel having a double hull (72) and a tank (71) as claimed in claim 1 arranged in the double hull.

11. A method for loading or unloading a vessel (70) as claimed in claim 10, in which a cold liquid product is conveyed through insulated pipelines (73, 79, 76, 81) from or to a floating or onshore storage installation (77) to or from the tank of the vessel (71).

12. A transfer system for a cold liquid product, the system comprising a vessel (70) as claimed in claim 10, insulated pipelines (73, 79, 76, 81) arranged so as to connect the tank (71) installed in the hull of the vessel to a floating or onshore storage installation (77) and a pump for forcing a flow of cold liquid product through the insulated pipelines from or to the floating or onshore storage installation to or from the tank of the vessel.

13. A method for manufacturing a sealed insulating tank, the method comprising:

providing a set of prefabricated panels (54), each prefabricated panel comprising, successively, a rigid base board (55), a first layer of thermal insulation (56) carried by the base board and forming, with the base board, an element of the secondary insulating barrier, a leaktight lining (52) which completely covers the first layer of thermal insulation being glued to the first layer of thermal insulation and which forms an element of the secondary sealing membrane, a second layer of thermal insulation (57) which covers a central zone of the first layer and the leaktight lining, and a rigid cover board (58) covering the second layer of thermal insulation and forming, with the second layer of thermal insulation, an element of the primary insulating barrier, the base board, the first layer of thermal insulation and the leaktight lining of the prefabricated panel having a first rectangular contour, whilst the second layer of thermal insulation and the cover board have a second rectangular contour of smaller dimensions than the first rectangular contour, with the result that the second layer of thermal insulation and the cover board do not cover an edge zone (59) of the leaktight lining along the four edges of the first rectangular contour, juxtaposing and fixing the prefabricated panels parallel to one another on the supporting structure (99) in such a way that the edge zone of the leaktight lining of a first prefabricated panel each time adjoins the edge zone of the leaktight lining of a second prefabricated panel, arranging sealing strips (65) so that they overlap the adjoining edge zones of the leaktight linings of the prefabricated panels, the sealing strips (65) being made from a flexible composite laminate material comprising at least one metal sheet bound to at least one fibrous layer and gluing the sealing strips (65) leaktightly to the leaktight linings (52) of the prefabricated panels in order to complete the secondary sealing membrane between the prefabricated panels, providing insulating blocks (66), the insulating panel having a layer of thermal insulation (67), a rigid board (68) fixed to an upper face of the layer of thermal insulation and a reinforcing mat (1) glued to a lower face of the layer of thermal insulation opposite the rigid board, the reinforcing mat (1) being made from a composite laminate material comprising at least one metal sheet sandwiched between two layers of glass fibers bound together by a polymeric resin, the reinforcing mat having a stiffness under tension which is greater than or equal to the stiffness under tension of the sealing strips (65), arranging the insulating blocks (66) on the sealing strips (65), an insulating block being each time arranged between the second layers of thermal insulation of two adjoining prefabricated panels in such as way as to complete the primary insulating barrier between the two prefabricated panels and to form a support wall which is substantially continuous with the rigid boards of the insulating blocks and the cover boards of the prefabricated panels, fixing the insulating blocks to the prefabricated panels by gluing the reinforcing mat of the insulating block to the underlying sealing strip, and fixing a primary sealing membrane (59) to the substantially continuous support wall.

14. The method as claimed in claim 13, furthermore comprising:

arranging a blocking strip of material (63) in a gap located between the first layers of thermal insulation of two adjoining prefabricated panels, arranging the sealing strip which completes the secondary sealing strip between the prefabricated panels without gluing to the blocking strip of material a central portion of the sealing strip which bridges the gap above the blocking strip of material, and fixing the insulating block having the reinforcing mat without gluing a central portion (6) of the reinforcing mat to the sealing strip (65).

15. The method as claimed in claim 14, in which the insulating block furthermore has a central pad (10) made from non-adhesive material fixed so that it projects from a surface of the reinforcing mat opposite the layer of thermal insulation of the insulating block, the method furthermore comprising the step of gluing the reinforcing mat (1) of the insulating block on either side of the central pad without gluing the central pad (10), and of arranging the insulating block on the sealing strip in such a way that the central pad covers the central portion (6) of the sealing strip without adhering to it.

16. The method as claimed in claim 14, in which the sealing strip furthermore has a central pad (10) made from non-adhesive material fixed so that it projects from a surface of the sealing strip facing the insulating block, the method furthermore comprising the step of gluing the sealing strip on either side of the central pad without gluing the central pad (10), and of arranging the insulating block on the sealing strip in such a way that the central portion of the reinforcing mat (1) covers the central pad without being glued to the central pad.

* * * * *